US006302365B1

(12) United States Patent
Catanzarite et al.

(10) Patent No.: US 6,302,365 B1
(45) Date of Patent: Oct. 16, 2001

(54) APPARATUS FOR SUPPORTING AN ORNAMENTAL ARTICLE RELATIVE TO AN OBJECT

(75) Inventors: David Catanzarite, Strongsville; Frank Zazzara, North Royalton, both of OH (US)

(73) Assignee: Lamrite West, Inc., Strongsville, OH (US)

( * ) Notice: Subject to any disclaimer, the term of this patent is extended or adjusted under 35 U.S.C. 154(b) by 0 days.

(21) Appl. No.: 09/072,089

(22) Filed: May 4, 1998

Related U.S. Application Data

(60) Provisional application No. 60/046,074, filed on May 9, 1997.

(51) Int. Cl.[7] ..... B42F 13/00; F16B 45/00

(52) U.S. Cl. ..... 248/339; 248/215; 248/304

(58) Field of Search ..... 248/339, 211, 248/215, 229.26, 228.7, 230.7, 231.81, 301, 304, 305

(56) References Cited

U.S. PATENT DOCUMENTS

D. 365,015 * 12/1995 Avinger ..... D8/373
394,792 * 12/1888 Shoe ..... 248/304
1,216,730 * 2/1917 Quiggle ..... 297/188.2
1,447,636 * 3/1923 White ..... 248/301
2,987,585 * 6/1961 Abysalh ..... 379/455
3,278,148 * 10/1966 Denaro ..... 248/210
3,737,188 * 6/1973 Myers ..... 294/27.1
3,982,719 * 9/1976 Kilborne ..... 248/489
5,074,419 * 12/1991 Smith ..... 211/17
5,535,971 * 7/1996 Adams ..... 248/215
5,553,823 * 9/1996 Protz, Jr. ..... 248/304

* cited by examiner

*Primary Examiner*—Anita King
(74) *Attorney, Agent, or Firm*—Fay, Sharpe, Fagan, Minnich & McKee, LLP

(57) ABSTRACT

A hanger device is disclosed which includes an attachment portion for securing the hanger device to a first object such as a door, at least one hanger portion for supporting an ornamental object such as a wreath or swag, and an intermediate member connecting the attachment portion to the hanger portion. The hanger portion also includes a plurality of support arms each having a hook portion for supporting a different part of the ornamental object to minimize relative movement between the hanger device and the ornamental object. The method of supporting the ornamental object includes securing the attachment portion to the first object, and positioning the ornamental object over the hook portions so that different parts of the ornamental object are supported by the hook portions to minimize relative movement between the ornamental object and the hanger device.

2 Claims, 3 Drawing Sheets

APPARATUS FOR SUPPORTING AN ORNAMENTAL ARTICLE RELATIVE TO AN OBJECT

CROSS REFERENCE TO RELATED APPLICATION

This application claims the benefit of U.S. Provisional Patent Application Ser. No. 60/046,074, filed May 9, 1997 and incorporated herein by reference.

BACKGROUND OF THE INVENTION

The present invention relates to a method and apparatus for supporting an ornamental article relative to an object without damaging or otherwise affecting the object.

It is known to enhance the decor of a living space with one or more ornamental articles such as wreaths and/or swags placed throughout. Such wreaths or swags can enhance a seasonal decor such as the Christmas holidays, or can enhance a particular motif such as country, southwestern, etc.

It is also desirable to position such an ornamental article over or in front of an interior or exterior entrance door, cupboard door, closet door, archway, or other object in a living space. In order to center such an ornamental article over such an object, it has heretofor been necessary to attach a peg, nail, hook, etc., to the object by means such as drilling, nailing, screwing, sticking, gluing, etc. As a result, the object can become permanently and visually marred, especially when the ornamental article is only temporarily placed over the object.

Further, when an ornamental article is positioned over or in front of a door as described above, and the door is opened and/or closed, the ornamental article tends to at least shift its position relative to the door, and may potentially fall off the door. If the ornamental object is fragile such as floral swag incorporating dried flowers, such shifting can damage the swag.

Accordingly, it has been considered desirable to develop a new and improved method and apparatus for securing an ornamental article relative to an object which meets the above-stated needs and overcomes the foregoing difficulties and others while providing better and more advantageous results.

SUMMARY OF THE INVENTION

In accordance with one aspect of the present invention, a new and improved hanger device is provided. The hanger device includes an attachment portion for securing the hanger device to a first object, and a hanger portion secured to the attachment portion for supporting a second object. The hanger portion includes a plurality of support arms each having a hook portion for supporting a different part of the second object to minimize relative movement between the hanger device and the second object.

In accordance with another aspect of the present invention, a new and improved method of supporting an ornamental object with a hanger device is disclosed. The hanger device includes an attachment portion, a hanger portion having a plurality of support arms each with a hook portion, and an intermediate member connecting the attachment portion to the hanger portion. The method includes securing the attachment portion to a second object, and positioning the ornamental object over the hook portions so that different parts of the ornamental object are supported by the hook portions to minimize relative movement between the ornamental object and the hanger device.

In accordance with another aspect of the present invention, a new and improved hanger device is provided. The hanger device includes an attachment portion for securing the hanger device over an upper end edge of a door, a first hanger portion secured to the attachment portion for supporting a first object in front of a first side of the door, and a second hanger portion secured to the attachment portion for supporting a second object in front of a second side of the door.

One advantage of the present invention is the provision of a new and improved hanger device which secures an ornamental article over or in front of an object without marring a surface of the object.

Another advantage of the present invention is the provision of a new and improved hanger device which can temporarily secure an ornamental article over or in front of an object and then be removed without marring the object.

A further advantage of the present invention is the provision of a new and improved hanger device which supports multiple parts of an ornamental object to minimize movement or shifting of the object relative to the hanger device.

Yet another advantage of the present invention is the provision of a new and improved hanger device which supports a first ornamental article on one side of a door, and supports a second ornamental article on an opposite side of a door.

Still further advantages of the present invention will become apparent to those of ordinary skill in the art upon reading and understanding the following detailed description of the preferred embodiment.

BRIEF DESCRIPTION OF THE DRAWINGS

The invention may take form in various components and arrangements of components and in various steps and arrangement of steps. The drawings are only for purposes of illustrating a preferred embodiment of the present invention and are not to be construed as limiting the invention.

DETAILED DESCRIPTION OF THE PREFERRED EMBODIMENTS

Figure 1:
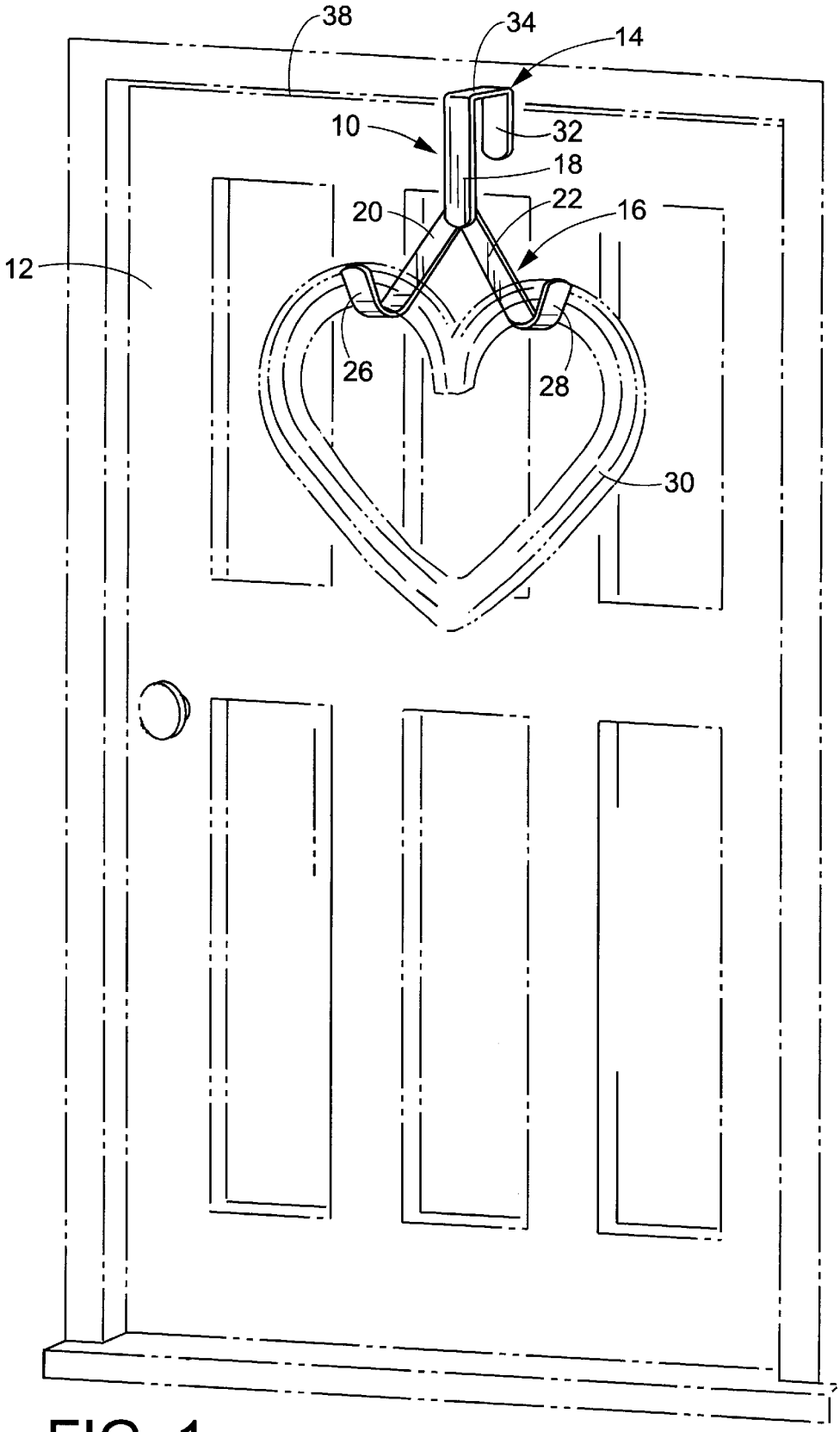
FIG. 1 is a perspective view of a hanger device for supporting or otherwise stabilizing an ornamental article over or in front of an object such as a door in accordance with the present invention.
Figure 3:
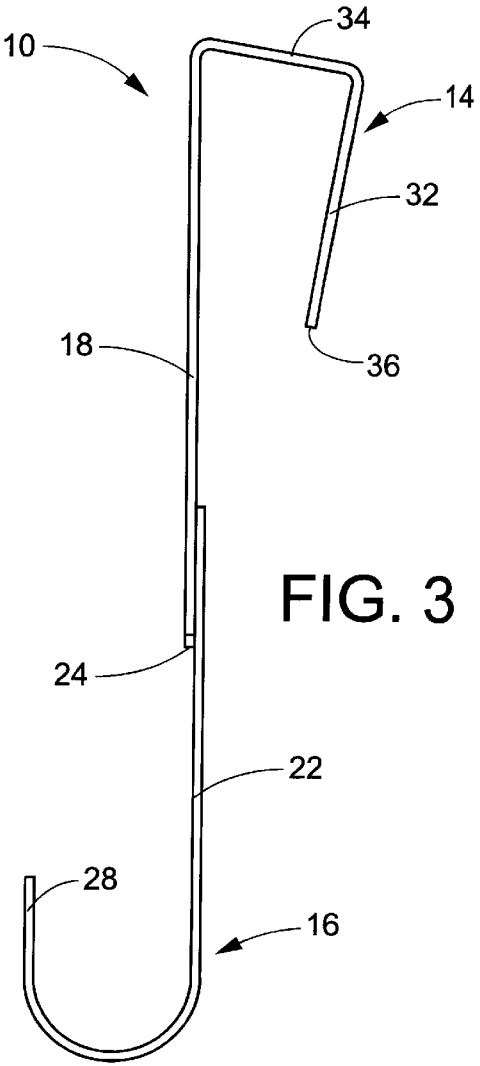
FIG. 3 is a side view of the hanger device of FIG. 1.
Figure 2:
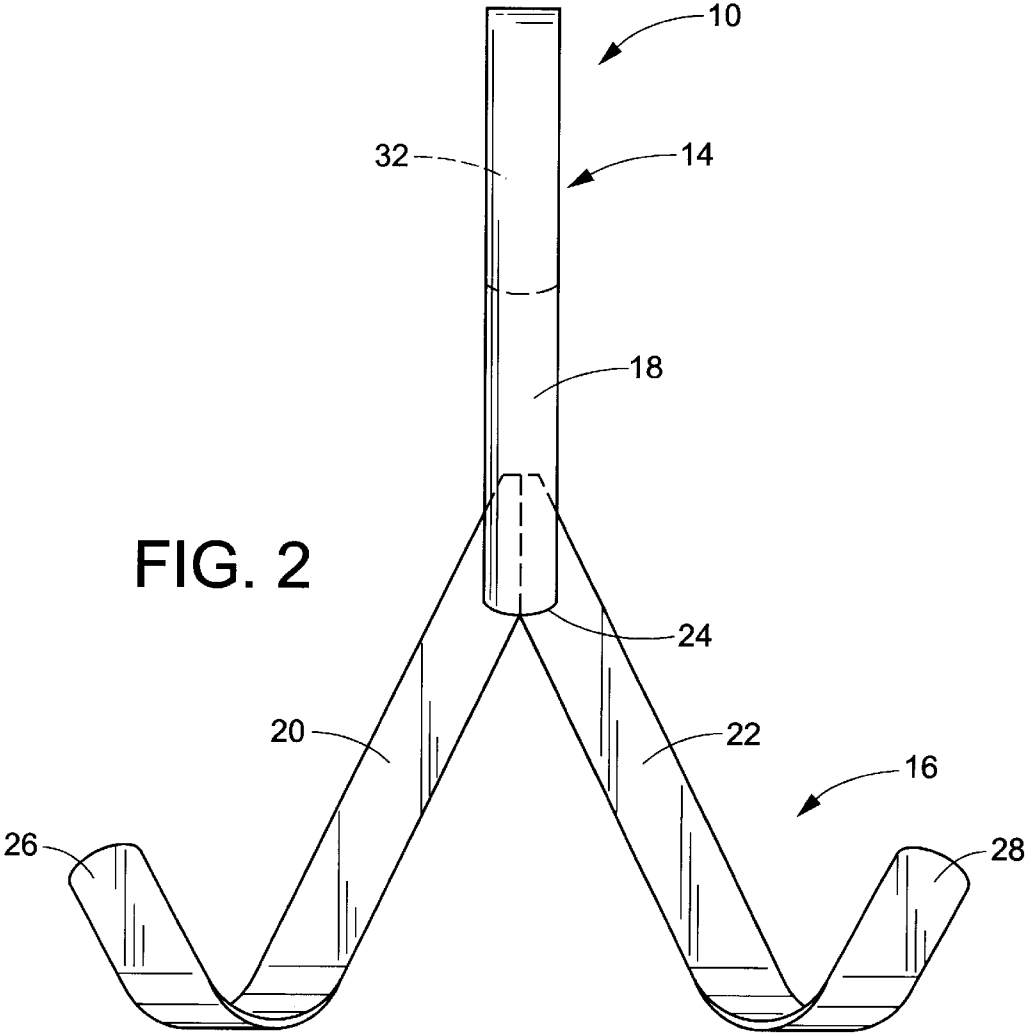
FIG. 2 is a front view of the hanger device of FIG. 1.

Referring now to FIGS. 1–3, a device 10 for securing an ornamental article over or in front of an object such as a door 12, is shown. The device 10 includes an attachment portion 14 connected to a hanger portion 16 by an intermediate member 18.

The hanger portion 16 includes first and second angled or V-shaped support arms 20, 22 diverging from a lower end 24 of the intermediate member 18. The free ends of the support arms 20, 22 form spaced-apart hook portions 26, 28, respectively, for contacting and supporting different parts of an ornamental article such as a swag or wreath 30 positioned over the hook portions 26, 28.

As best seen in FIGS. 2 and 3, the support arms 20, 22 spiral laterally outward in opposite directions around an imaginary, horizontally-extending, right cylinder to form the spaced-apart hook portions 26, 28, whereby the free ends of the hook portions diverge in a substantially upward manner.

It should be appreciated that by supporting different parts of the wreath 30, the hanger device 10 stabilizes the wreath to prevent or otherwise minimize relative movement of the wreath with the hanger device 10 and/or the door 12 when the door is opened and/or closed. In addition, if the door 12 is an exterior door, the hanger device 10 further stabilizes the wreath when exposed to wind and rain.

Thus, the hook portions 26, 28 cooperate to support the wreath in a stable manner so that the wreath 30 remains in place when the door 12 is opened and closed. That is, by providing a plurality of hook portions in supporting contact with different portions of the wreath, relative movement between the wreath and the door can be prevented, or at least minimized.

The attachment portion 14 includes a first arm 32 spaced from the intermediate member 18 by a second arm 34. The second arm 34 is secured between the upper end edges of the first arm 32 and the intermediate member 18. The first arm 32 is angled relative to the intermediate member 18 whereby a lower free end 36 of the arm 32 is positioned closer to the intermediate member 18 than an upper end of the arm 32.

The distance separating the lower free end 36 of the arm 32 from the intermediate member 18 can be less than a thickness of the door 12 so that the attachment portion 14, and more particularly, the intermediate member 18 and first arm 32, can be resiliently urged into contact with an upper end edge 38 of the door 12 when the attachment portion 14 is placed over the upper edge 38 of the door 12. Thus, the attachment portion 14 clamps around the door so as to further stabilize the wreath 30 relative to the door 12 to further prevent or minimized relative movement therebetween.

The length of the intermediate member 18 can vary so as to locate the hanger portion 16 at a desired position away from the upper end edge of the door 38. The device 10 can be formed from any type of material including plastic, metal, wood, etc. The device 10 can be formed by molding a unitary structure or can be formed from separate pieces which are secured together by means such as spot welding, gluing, attaching, and securing, etc. The device 10 can be formed from sheet material, having a planar cross-section, or rod or wire material having any type of cross-section including circular, square, rectangular, triangular, etc.

In operation, the attachment portion 14 is secured to the door 12 by resiliently urging the lower free end 36 of the first arm in a direction away from the intermediate member 18 so that the upper end edge of the door can be positioned between the intermediate member 18 and the first arm 32. It should be appreciated that the first arm 32 can act as a cantilever relative to the second arm 34, and/or the second arm 34 can act as a cantilever relative to the intermediate member 18 to develop a spring force which acts to clamp the attachment portion 14 around the door.

The wreath or swag can then be placed over the hook portions of each support arm 20, 22 so as to be supported in a stable manner over or in front of the door 12.

Figure 4:
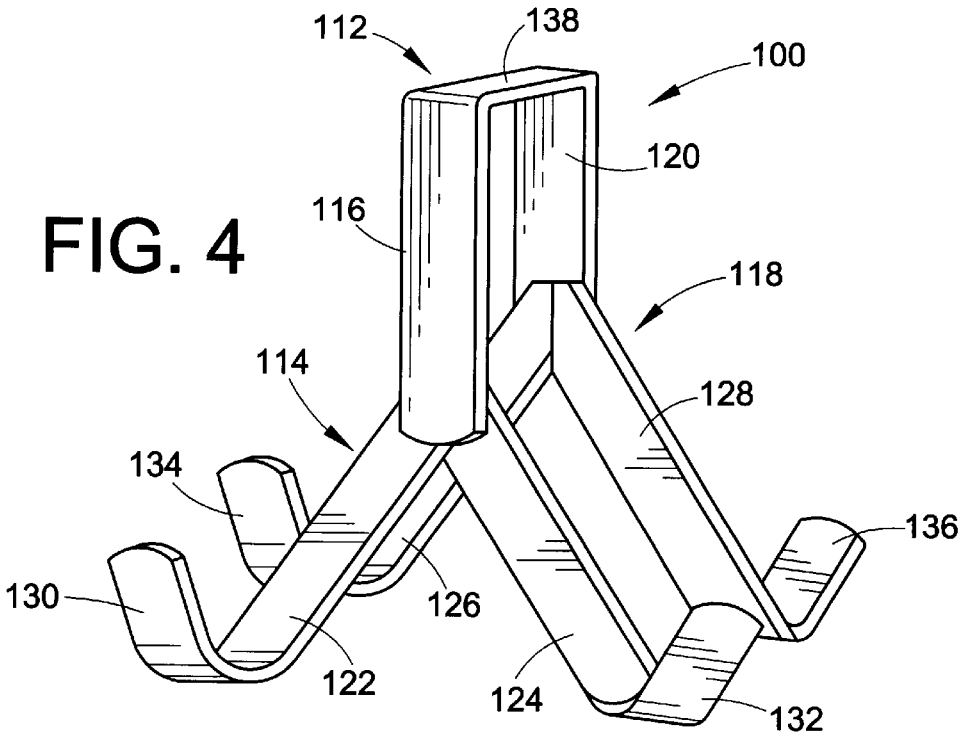
FIG. 4 is a perspective view of a second hanger device in accordance with the present invention.

Referring now to FIG. 4, a device 100 for securing an ornamental article over or in front of each side surface of an object such as a door, is shown. The device 100 includes an attachment portion 112 connected to a first hanger portion 114 by a first intermediate member 116, and connected to a second hanger portion 118 by a second intermediate member 120.

The hanger portions 114, 118 each include first and second pairs of angled or V-shaped support arms 122, 124, and 126, 128, respectively, diverging from lower ends of the intermediate members 116, 120. The free ends of each pair of support arms form spaced-apart pairs of hook portions 130, 132, and 134, 136 for contacting and supporting different parts of an ornamental article such as a swag or wreath positioned over each pair of hook portions.

The pairs of support arms 122, 124, and 126, 128 spiral laterally outward in opposite directions around imaginary, horizontally-extending, right cylinders to form the pairs of hook portions 130, 132, and 134, 136 whereby the free ends of each pair of hook portions diverge in a substantially upward manner.

It should be appreciated that by each hanger portion 114, 118 supporting different parts of an ornamental article, the hanger device 100 can stabilize at least two ornamental articles to prevent or otherwise minimize relative movement of the articles with the hanger device 100 and/or a door when the door is opened and/or closed. In addition, if the door is an exterior door, the hanger device 100 can further stabilize the ornamental article that may be exposed to wind and/or rain.

The attachment portion 112 includes a transverse arm 138 secured to or joining the upper end edges of the intermediate members 116, 120. The intermediate members may converge in a direction away from the transverse arm 138 so that the hanger portions 114, 118 clamp around the object so as to further stabilize the wreath 30 relative to the object to further prevent or minimized relative movement therebetween.

The length of the intermediate members 116, 120 can vary so as to locate the hanger portions 114, 118 at different positions relative to the object or each other. The device 100 can be formed from any type of material including plastic, metal, wood, etc. The device 100 can be formed by molding a unitary structure or can be formed from separate pieces which are secured together by means such as spot welding, gluing, attaching, and securing, etc. The device 100 can be formed from sheet material, having a planar cross-section, or rod or wire material having any type of cross-section including circular, square, rectangular, triangular, etc.

In operation, the attachment portion 112 is secured to an object such as a door by resiliently urging the hanger portions 114, 118 apart so that the upper end edge of the door can be positioned between the intermediate members 114, 118. A first ornamental object can then be placed over the first pair of hook portions 130, 132 so as to be supported in a stable manner over or in front of a first side or surface of the object, and a second ornamental object can then be placed over the second pair of hook portions 134, 136 so as to be supported in a stable manner over or in front of a second side or surface of the object.

Figure 5:
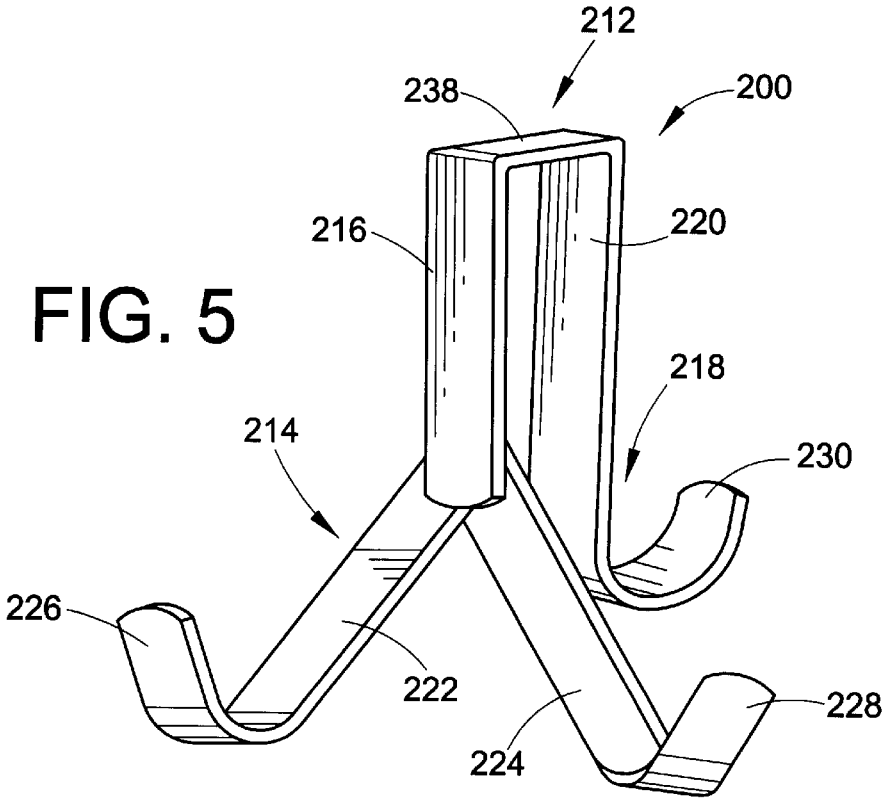
FIG. 5 is a perspective view of a third hanger device in accordance with the present invention.

Referring now to FIG. 5, a device 200 for securing an ornamental article over or in front of each side surface of an object such as a door, is shown. The device 200 includes an attachment portion 212 connected to a first hanger portion 214 by a first intermediate member 216, and connected to a second hanger portion 218 by a second intermediate member 220.

The first hanger portion 214 includes first and second angled or V-shaped support arms 222, 224 diverging from a lower end of the intermediate member 216. The free ends of the support arms 222, 224 form spaced apart hook portions 226, 228, respectively, for contacting and supporting different parts of an ornamental article such as a swag or wreath positioned over the hook portions 226, 228. The support arms 222, 224, spiral laterally outward in opposite directions around an imaginary, horizontally-extending, right cylinder to form the hook portions 226, 228 whereby the free ends of hook portions diverge in a substantially upward manner.

It should be appreciated that by supporting different parts of an ornamental object, the hanger portion 214 stabilizes the object to prevent or otherwise minimize relative movement of the object with the hanger device 200 and/or a door when the door is opened and/or closed. Thus, the hook portions 226, 228 cooperate to support the ornamental object in a stable manner so that the object remains in place when a door is opened and closed. That is, by providing a plurality of hook portions in supporting contact with different portions of the ornamental object, relative movement between the object and the door can be prevented, or at least minimized.

The hanger portion 218 includes a hook portion 230 extending from a lower portion of the intermediate member 220 for supporting an ornamental object on an opposing side of a door, or the like.

The attachment portion 212 includes a transverse arm 238 secured to or joining the upper end edges of the intermediate members 216, 220. The intermediate members may converge in a direction away from the transverse arm 238 so that the hanger portions 214, 218 clamp around the object so as to further stabilize the ornamental article relative to the door to further prevent or minimized relative movement therebetween.

The length of the intermediate members 216, 220 can vary so as to locate the hanger portions 214, 218 at different positions relative to the object or each other. The device 200 can be formed from any type of material including plastic, metal, wood, etc. The device 200 can be formed by molding a unitary structure or can be formed from separate pieces which are secured together by means such as spot welding, gluing, attaching, and securing, etc. The device 200 can be formed from sheet material, having a planar cross-section, or rod or wire material having any type of cross-section including circular, square, rectangular, triangular, etc.

In operation, the attachment portion 212 is secured to an object such as a door by resiliently urging the hanger portions 214, 218 apart so that the upper end edge of the door can be positioned between the intermediate members 216, 220. A first ornamental object can then be placed over the first pair of hook portions 226, 228 so as to be supported in a stable manner over or in front of a first side or surface of the object, and a second ornamental object can then be placed over the hook portion 230 so as to be supported over or in front of a second side or surface of the object.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

For instance, the ornamental object shown in the drawing is illustrated as a heart-shaped wreath. However, it is contemplated that wreathes and other ornamental articles having all other shapes can be supported by the hanger device of the present invention.

Having thus described the preferred embodiments, the invention is now claimed to be:

1. A unitary device for supporting a first associated object in front of a first side of an associated door and for supporting a second associated object in front of a second side of the associated door, the device comprising:

a transverse arm adapted to extend over a top of the associated door, the arm having first and second ends;

a first intermediate member cantilevered from the first end of the transverse arm and adapted to contact the first side of the associated door;

a second intermediate member cantilevered from the second end of the transverse arm and adapted to contact the second side of the associated door, the first and second intermediate members cooperating with the transverse arm to develop a spring force for clamping the intermediate members to the associated door;

a first V-shaped hanger portion extending from a lower end of the first intermediate member and including first and second support arms diverging from the first intermediate support member, the first and second support arms adapted to spiral laterally outward from the first side of the associated door around an imaginary horizontally-extending right cylinder to form upwardly divergent hook portions that are adapted to support different portions of the first associated object; and a second V-shaped hanger portion extending from a lower end of the second intermediate member and including third and fourth support arms diverging from the second intermediate support member, the third and fourth support arms adapted to spiral laterally outward from the second side of the associated door around an imaginary horizontally-extending right cylinder to form upwardly divergent hook portions that are adapted to support different portions of the second associated object.

2. A unitary device for supporting a first associated object in front of a first side of an associated door and for supporting a second associated object in front of a second side of the associated door, the device comprising:

a transverse arm adapted to extend over a top of the associated door, the arm having first and second ends;

a first intermediate member cantilevered from the first end of the transverse arm and adapted to contact the first side of the associated door;

a second intermediate member cantilevered from the second end of the transverse arm and adapted to contact a second side of the associated door, the first and second intermediate members cooperating with the transverse arm to develop a spring force for clamping the intermediate members to the associated door;

a first V-shaped hanger portion extending from a lower end of the first intermediate member and including first and second support arms diverging from the first intermediate support member, the first and second support arms adapted to spiral laterally outward from the first side of the associated door around an imaginary horizontally-extending right cylinder to form upwardly divergent hook portions that are adapted to support different portions of the first associated object; and a second hanger portion extending from a lower end of the second intermediate member and including a third support arm forming an upward hook portion adapted to support the second associated object.

* * * * *